166-250 SR
FIP8011 OR 4,083,401

United States Patent [19]
Rankin

[11] 4,083,401
[45] Apr. 11, 1978

[54] APPARATUS AND METHODS FOR TESTING EARTH FORMATIONS

[75] Inventor: Emmitt Edward Rankin, Aberdeen, Scotland

[73] Assignees: Gearhart-Owen Industries, Inc., Fort Worth, Tex.; Petro-Data C.A., Caracas, Venezuela

[21] Appl. No.: 800,904

[22] Filed: May 27, 1977

[51] Int. Cl.[2] ..... E21B 47/00; E21B 43/12
[52] U.S. Cl. ..... 166/250; 166/332
[58] Field of Search ..... 166/250, 314, 332; 73/151

[56] References Cited

U.S. PATENT DOCUMENTS

| | | | |
|---|---|---|---|
| 2,790,501 | 4/1957 | Garrett et al. | 166/332 |
| 3,051,243 | 8/1962 | Grimmer et al. | 166/332 |
| 3,073,392 | 1/1963 | Dinning et al. | 166/332 |
| 3,107,729 | 10/1963 | Barry et al. | 166/250 |
| 3,151,681 | 10/1964 | Cochran | 166/332 |

*Primary Examiner*—James A. Leppink
*Attorney, Agent, or Firm*—Wm. T. Wofford; James M. Peppers

[57] ABSTRACT

Improved apparatus and methods are provided for conducting drill stem and production testing operations. A bypass sub removably receives a wireline tool in sealing engagement within a bypass sub bore, with the bypass sub including bypass passage means and selectively actuable port closure means to permit fluid from below the bypass sub to flow into conduit means above the bypass sub when the wireline tool is seated and secured in the bypass sub. In one embodiment, the means for selectively actuating the port closure means is a motorized shifter means incorporated in the wireline tool. The wireline tool carries selected sensor devices for sensing earth formation characteristics. Improved and unique means are provided for securing the wireline tool in the bypass sub and for selectively engaging the motorized shifter apparatus with the port closure means. In addition, unique "fail safe" means are provided to ensure that the wireline tool and the bypass sub can be effectively removed from the well even in case of a malfunction of the motorized shifter means.

13 Claims, 10 Drawing Figures

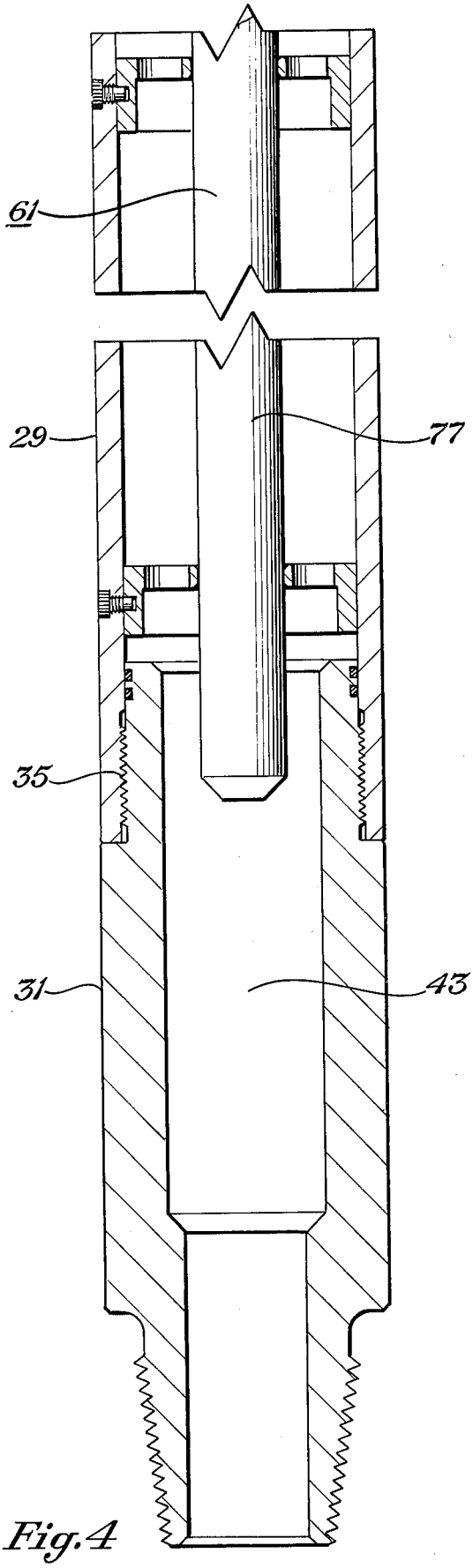
Fig. 4
Fig. 5
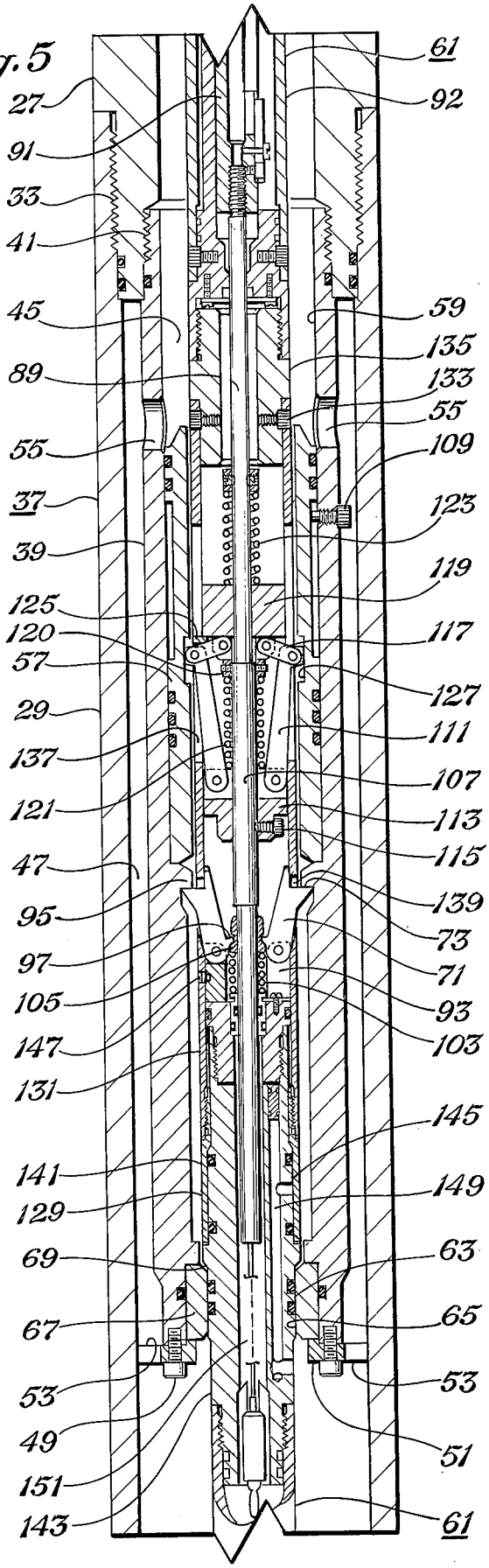

APPARATUS AND METHODS FOR TESTING EARTH FORMATIONS

FIELD OF THE INVENTION

The invention relates to apparatus and methods for testing earth formations and more particularly to such apparatus and methods wherein a concurrent surface indication of an earth formation characteristic during a test operation is provided. A typical application of the invention is to provide a concurrent surface indication of formation pressure during a drill stem or a production testing operation in the petroleum industry.

BACKGROUND OF THE INVENTION

The technique of drill stem testing is conventionally employed to evaluate the production potential of selected zones in the earth formations of a well, prior to completion. The usual practice has been to assemble the drill stem test equipment in the lower end of the drill pipe and run it into the well. The apparatus would include a releasable packer that can be set by manipulation of the drill pipe to isolate the formation under test from the well bore annulus around the drill pipe above the formation. The apparatus would also include valve means controlled by manipulation of the drill pipe to permit flow of fluid from the formation into the drill pipe and to above ground equipment or to shut off such flow. The apparatus would further include pressure sensor and recorder devices. A part of the drill stem test involves making a record of the pressures encountered by the pressure sensor devices under various conditions. Since there is no concurrent surface indication of the pressures, it is necessary to estimate or guess at certain of the time intervals involved. For example, when the formation flow is shut in, the time it takes to reach a steady state formation pressure must be guessed at. If insufficient time is allowed, erroneous information or inadequate information is obtained. If too much time is allowed, then, valuable rig waiting time is expended. It is, thus, apparent that there is a need to provide a concurrent surface indication of earth formation characteristics, such as the pressures encountered by appropriate fluid pressure sensors in the course of a drill stem test. Some efforts have been made along these lines, as exemplified by U.S. Pat. No. 3,041,875, but the results have not proved to be entirely satisfactory.

It is, accordingly, an object of this invention to devise improved apparatus and methods to provide concurrent surface indications of earth formation characteristics during drill stem testing operations.

There is also a need to provide for concurrent surface indications of earth formation characteristics during similar testing operations in production wells, and it is a further object of this invention to provide improved methods and apparatus to accomplish this purpose.

For a further understanding of the invention and further objects, features, and advantages thereof, reference may now be had to the following description, taken in conjunction with the accompanying drawings.

SUMMARY OF THE INVENTION

In accordance with the invention, improved apparatus and methods are devised to provide for concurrent surface indication of an earth formation characteristic or characteristics during a drill stem testing operation or a production testing operation. In its broader aspects, the invention contemplates, in the case of a drill stem test, that a bypass sub will be run into a well on drill pipe to a location above the formation to be tested, together with a releasable packer means for permitting fluid flow from the formation to be tested to the bypass sub but otherwise isolating formation fluid below the packer means from wellbore fluids above the packer means. The bypass sub would include means for removably receiving a wireline tool in sealing engagement with a bore of the bypass sub, as well as selectively actuable closure means to control the opening or closing of ports in the bypass sub, so as to permit fluid flow from the formation to the drill pipe above the wireline tool when the wireline tool is seated in the bypass sub. Also provided, in accordance with the invention, is a means for selectively actuating the above mentioned closure means while the wireline tool is in place in the bypass sub. The wireline tool would include selected earth formation characteristic sensor devices, usually including one or more fluid pressure sensor devices. In accordance with a preferred embodiment of the invention, the port closure means is a sleeve valve and the means for actuating the sleeve valve is a motorized sleeve shifter means that is incorporated in the wireline tool. The invention further contemplates improved apparatus for releasably securing the wireline tool in the bypass sub, and unique apparatus and arrangement for selectively engaging the motorized shifter apparatus with the sleeve valve. In accordance with another aspect of the invention, unique "fail safe" means are provided to ensure that the wireline tool can be effectively removed from the well even in case of a malfunction of the motorized shifter means. In the case of a production testing operation, the apparatus is essentially the same as for drill stem testing except that the bypass sub is lowered by suitable means into the production tubing to the test location where it is secured by suitable means to the production tubing. Also, the bypass sub is modified so that the production tubing interior wall forms a part of the bypass passage from the fluid below the bypass sub to the bypass sub ports.

BRIEF DESCRIPTION OF THE DRAWINGS

FIGS. 1–4 are schematic partial longitudinal section views showing (when placed end to end) apparatus constructed in accordance with a preferred embodiment of the invention and including a bypass sub and a wireline tool, for use in drill stem testing operations; with the apparatus being shown in a first stage of operation.

FIG. 5 is like FIG. 3 except that the apparatus is shown in a second stage of operation.

DESCRIPTION OF PREFERRED EMBODIMENTS

Figure 8:
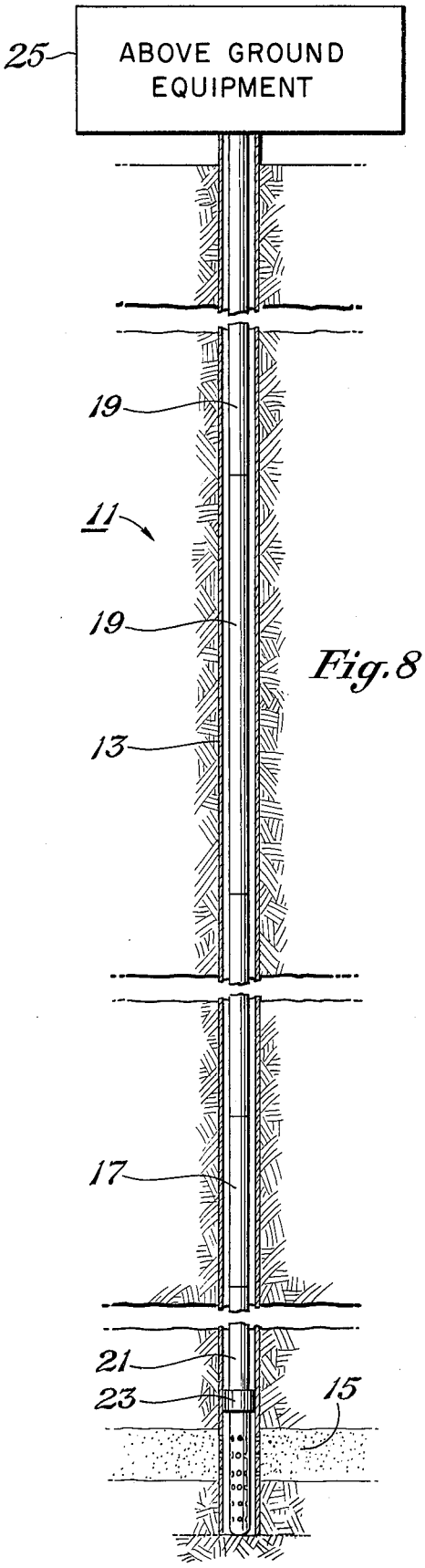
FIG. 8 is a general view, schematically showing apparatus of the invention in place for a drill stem test in a well.
Figure 2:
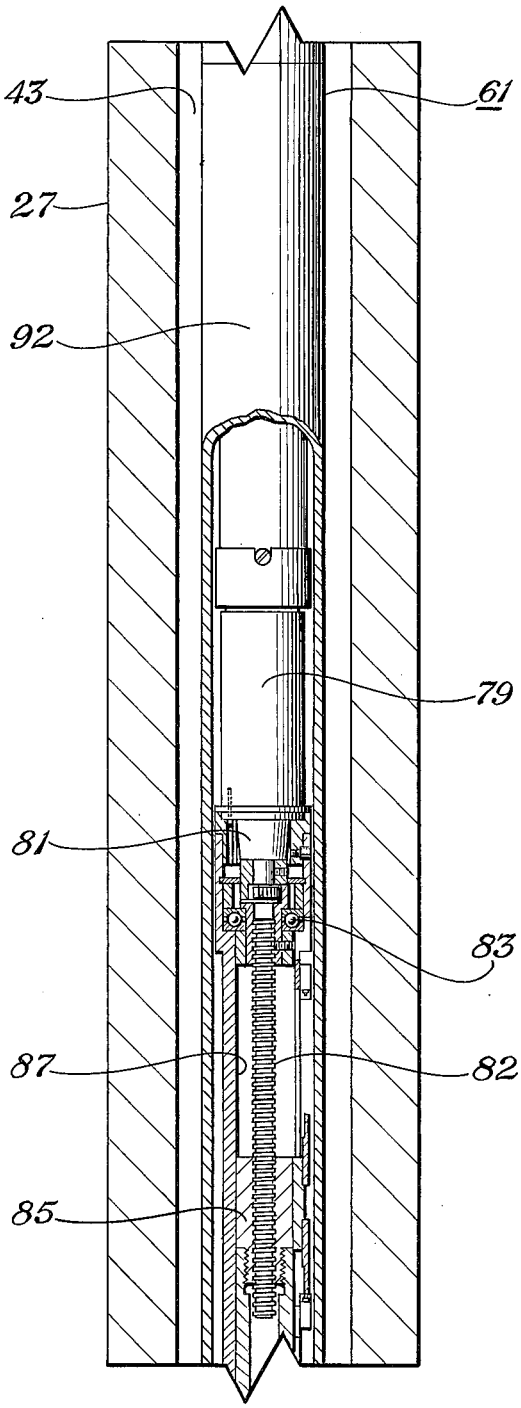

Referring now to the drawings, in FIG. 8 there is shown a typical well 11 in which casing 13 has been set and perforated to admit fluids from the formation zone 15 to be tested. A bypass sub 17, which may be like that shown by FIGS. 1–4, has been run into the well on drill pipe 19. A drill stem test assembly 21 including a releasable packer 23 is attached to the lower end of the bypass sub 17. Conventional above ground equipment, shown as a block 25, is utilized.

In accordance with the preferred embodiment, shown by FIGS. 1–7, the bypass sub 17 is made up of top, intermediate and bottom outer housing portions 27, 29, 31 in the form of cylindrical tubular members having a common outer diameter and joined by means of respective threaded portions 33, 35 to make up a unitary outer housing structure 37.

The bypass sub 17 has an inner housing 39 in the form of a cylindrical tubular member which is joined at its upper end to the lower end of said top outer housing portion 27 by means of threads 41. The bypass sub 17 has a bore 43 which extends throughout its length and includes what may be termed a bypass portion 45 formed by the interior of the inner housing 39. The interior diameter of the intermediate outer housing portion 29 is greater than that of the top and bottom portions 27, 31, so that a bypass passage means is provided in the form of an annulus 47 occupying a space between the exterior of the inner housing 39 and the adjacent interior of the intermediate outer housing portion 29. The inner housing 39 is fixed at its lower end by means of screws 49 to an inwardly extending flange 51 which is fixed to the intermediate outer housing portion 29. The flange 51 has peripheral passages 53, which may be termed lower port means, to permit bypass fluid flow into the bypass passage means annulus 47.

Upper port means are provided in the form of openings 55 disposed about a circumference of the inner housing 39 at its upper region, to permit fluid flow between the bypass passage means or annulus 47 and the portion of the bypass sub bore 43 above the location of the openings 55. Closure means for selectively opening and closing the upper port means 55 is provided. The closure means is in the form of a sleeve valve 57 which is reciprocable within an enlarged valve cylinder portion 59 of the inner housing 39.

The bore bypass portion 45 (which is the interior of the inner housing 39) has provisions in its lower portion (beneath the valve cylinder portion 59) for receiving in sealing engagement and securing in place a wireline tool 61. The wireline tool 61 generally has an elongated cylindrical shape with maximum exterior diameter such as to permit the wireline tool to be received within the bore bypass portion 45. The wireline tool 61 has a seat sealing surface 63 which mates with a sealing surface 65 of a seat seal ring 67 which is retained at the lower end of the inner housing 39. A seat shoulder 69 on the wireline tool 61 immediately above the seat sealing surface 63 prevents further downward movement of the wireline 61, while lower latch dogs 71 may be extended outwardly from the wireline tool 61 to engage a shoulder 73 on the inner housing interior just beneath the valve cylinder portion 59, to prevent upward movement of the wireline tool 61.

A primary function of the wireline tool 61 is to carry earth formation characteristic sensors and means for deriving from the sensors suitable electric signals which are a function of the formation characteristics sensed, and which electric signals may be transmitted via the wireline 75 from which the wireline tool 61 is suspended to above ground equipment 25. In the embodiment shown by FIGS. 1–7, the sensors are carried by a bottom section 77 of the wireline tool and include at least such pressure sensors as are necessary for a drill stem test. The sensor carrying section 77 of the tool 61 can, of course, carry such sensors as may be desirable for the test or tests to be made.

A second important function of the wireline tool is to provide means for securing the wireline tool 61 in its seated position for the duration of the test or tests to be made and then releasing the tool so that it can be withdrawn from the well 11. In the embodiment shown by FIGS. 1–7, this function is performed by lower latch dogs 71, which are powered for movement by an electric motor 79 which is controlled from the above ground equipment 25. The electric motor 79, through reduction gearing 81, rotates a drive screw 82. The drive screw is supported at its upper end portion by suitable bearing means 83 and engages an internally threaded drive sleeve 85 which is reciprocable within a drive cylinder 87. The drive sleeve 85 is connected to a drive shaft 89 by means of a drive tube 91 that is threadedly connected at its upper end to the drive sleeve 85 and at its lower end to the drive shaft 89. The bore of the drive tube 91 accommodates the drive screw 82 when it projects within the drive tube. The electric motor 79, drive screw 82, drive sleeve 85 and drive tube 91 are all carried by a top section 92 of the wireline tool 61.

Figure 1:
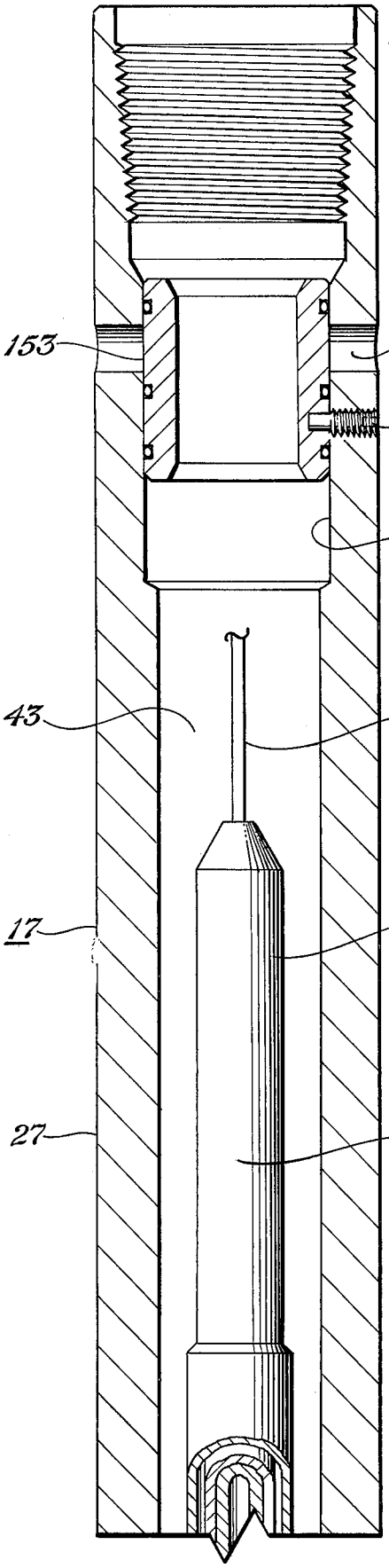
Figure 3:
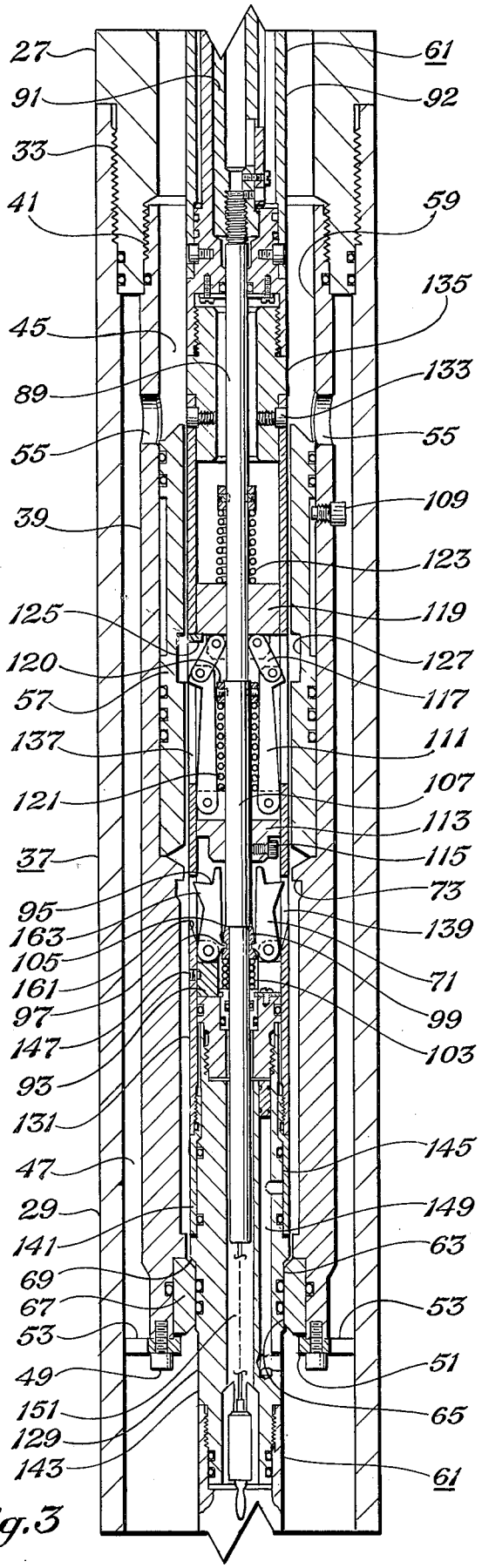

The lower latch dogs 71 are pivotally fixed at their lower ends to a boss 93, so as to be upwardly facing and are provided with notches 95 at their free ends to engage with the bypass sub inner housing shoulder 73 when in the extended position. The vertical extensions of the notches 95 may engage the cylindrical body portion 131 above the slots 137 to limit extension of lower latch dogs 71. The lower latch dogs 71 have inwardly extending protrusions 97 near their pivoted ends, which protrusions engage notches or openings in a spool 99. The spool 99 is slidable on a lower portion 101 of the drive shaft 89 and is biased for movement in the upward direction by a first compression spring 103. The compression of spring 103 is governed by the position of the drive shaft 89. A shoulder 105 formed by an enlarged intermediate portion 107 of the drive shaft 89 is engageable with the upper end of the spool 99. The drive shaft 89 can move downwardly to compress the spring 103 and cause the lower latch dogs 71 to retract, as shown in FIG. 3. The drive shaft 89 can also move upwardly, permitting the spool 99 to move upwardly under the urging of the spring 103, so that the lower latch dogs 71 can be moved to their extended position, as shown by FIG. 5.

A third important function of the wireline tool is to provide means for selectively actuating a bypass passage closure means while the wireline tool is seated in place in the bypass sub. In the embodiment of FIGS. 1–7, the closure means is the sleeve valve 57, which is free to be reciprocated within the valve cylinder portion 59, within the limits determined by suitable stop means 109. The sleeve valve 57 is actuated by upper latch arms 111 which engage the sleeve valve 57 and move same in response to movement of the drive shaft 89. The upper latch arms 111 are pivotally fixed at their lower ends to a first slidable collar 113 that is received by the drive shaft 89 and is in turn fixed by a first shear pin 115 to the drive shaft 89. A link 117 is pivotally connected at one end to the upper end of each upper latch arm 111 and at the other end to a second slidable collar 119 that is received by the drive shaft 89 and is free to move relative to the drive shaft 89. A second compression spring 121 is received by the drive shaft 89 and is fixed at its upper end to the drive shaft and rests its lower end on said first slidable collar 115. This second compression spring 121 is normally compressed and performs no function in the normal operation of the wireline tool 61. A third compression spring 123 is received by the drive shaft 89 and is fixed at its upper end to the drive shaft and may be engaged at its lower end by said second slidable collar 119. A stop means 125 is provided to limit the downward movement of the second slidable collar 119 in a manner to be described later herein. When the upper latch arms 111 are in their extended position, they are positioned within an annular recess 127 on the sleeve valve interior surface, so that they may engage a shoulder formed by the upper extremity of the recess 127 to push the sleeve valve 57 upwardly, or they may engage a shoulder formed by the lower extremity of the recess 127 to pull the sleeve valve 57 downwardly.

The portion of the wireline tool 61 that is disposed between the top and bottom sections 92, 77 may be termed the intermediate section 129. This intermediate section 129 carries the drive shaft 89, the upper latch arms 111 and associated structure, the lower latch dogs 71 and associated structure, and the seating portion including the seat sealing surface 63, as well as certain "fail safe" structure to be described later herein. The intermediate section 129 includes a cylindrical body portion 131 which is attached at its upper end by suitable means such as screws 133 to a connector sub 135. This cylindrical body portion 131 is provided with longitudinally extending slots 137 through which the upper latch arms 111 may extend as the sleeve valve 57 is moved from closed to open position or vice versa. This cylindrical body portion 131 is also provided slots 139 through which the lower latch dogs 71 can pass when extended. This cylindrical body portion 131 further includes a fail safe seal cylinder 141 disposed at its lower end. The wireline tool intermediate section 129 also includes a lower body portion 143, a part of which extends upwardly into the interior of the lower end portion of the cylindrical body portion 131. This lower body portion 143 carries the seat sealing surface 63 which engages with the bypass sub sealing surface 65, and the seating shoulder 69 previously herein referred to. The lower body portion 143 is provided on its exterior a short distance above the seat sealing surface 63, a fail safe sealing surface 145 which mates with the fail safe seal cylinder 141. The cylindrical body portion 131 is normally retained against movement relative to the lower body portion 143 by means of a second shear pin 147. A pressure equalizing passage 149 is provided in the lower body portion 143, which passage communicates with the bypass sub bore 43 above and below the wireline tool seat sealing surface 63 when not blocked by the fail safe seal cylinder 141. The lower body portion 143 is provided a central bore 151 which accommodates the lower end portion of the drive shaft 89 as it is reciprocated; and also the necessary electrical connections from the sensor devices in the bottom section 77 of the wireline tool 61 via a bore (not shown) in the drive shaft 89 and to the above ground equipment 25.

In the embodiment shown in FIGS. 1–7, there is further provided circulation valve means disposed at the upper end region of the bypass sub 17 and comprising circulation ports 159 communicating between the bypass sub bore 43 and the outside of the bypass sub 17, and a normally closed slidable sleeve 153. The sleeve 153 is received by a sealing cylinder portion 155 of the bypass sub 17 and is normally retained by a third shear pin 157.

In operation of the embodiments shown in FIGS. 1–7, the bypass sub 17 is run into the well 11 on drill pipe 19, with a releasable packer incorporated in an assembly that is attached below the bypass sub. When running into the well, the bypass sub sleeve valve 57 is in the open position. A sufficient length of drill pipe (not shown) is provided as necessary so as to locate the releasable packer immediately above the formation to be tested when the lowermost portion of the drill pipe assembly is supported against vertical movement. Next, the wireline tool 61 is run into the drill pipe 19 and seated in the bypass sub 17, with the seat sealing surface 63 of the wireline tool 61 mating with the sealing surface 65 of the bypass sub 17. When seated, the wireline tool 61 is prevented from moving downward by the contact of the seat shoulder 69 with a mating shoulder surface of the seat seal ring 67, and is secured against upward movement by the resting of the notches 95 of the extended lower latch dogs 71 against bypass sub shoulder 73. When the wireline tool 61 is run into the well 11, the drive shaft 89 is at its lowermost position, and both the lower latch dogs 71 and the upper latch arms 111 are in their retracted position, as shown in FIG. 3. The lower latch dogs 71 are extended by operating the electric motor 79 in a first direction to cause the drive sleeve 85 to be drawn upwardly, thus moving the drive shaft 89 upwardly until it has reached its intermediate position, at which time the electric motor 79 is stopped by means of a conventional limit switch (not shown).

The stop means 125 is fixed to cylindrical body portion 131, as shown by FIG. 3, such that when the drive shaft 89 is in its lowermost position, the second slidable collar 119 rests on the stop means 125, compressing the third compression spring 123 and the upper latch arms 111 are retracted. As the drive shaft 89 is drawn upwardly, the second slidable collar 119 is caused by the third compression spring 123 to remain positioned on the stop means 125 until the upper latch arms 111 have reached their extended position, as shown by FIG. 5. The extension of the upper latch arms 111 is limited by engagement of the second slidable collar 119 with spring retainer collar 120. It is apparent that the upper latch arms 111 may be fully extended when the drive shaft 89 has reached its intermediate position, or they may be only partially extended at that point, depending upon the structural relationship of the lower latch dogs 71 and the upper latch arms 111.

After the wireline tool 61 has been seated, the earth formation characteristic sensor devices of the wireline tool 61 are checked out to see that they will function properly, and then the releasable packer 23 is set. The setting of the releasable packer 23 permits fluid flow from the formation to be tested to the bypass sub 17, by otherwise isolates formation fluid below the releasable packer 23 from wellbore fluids above the releasable packer 23.

Figure 6:
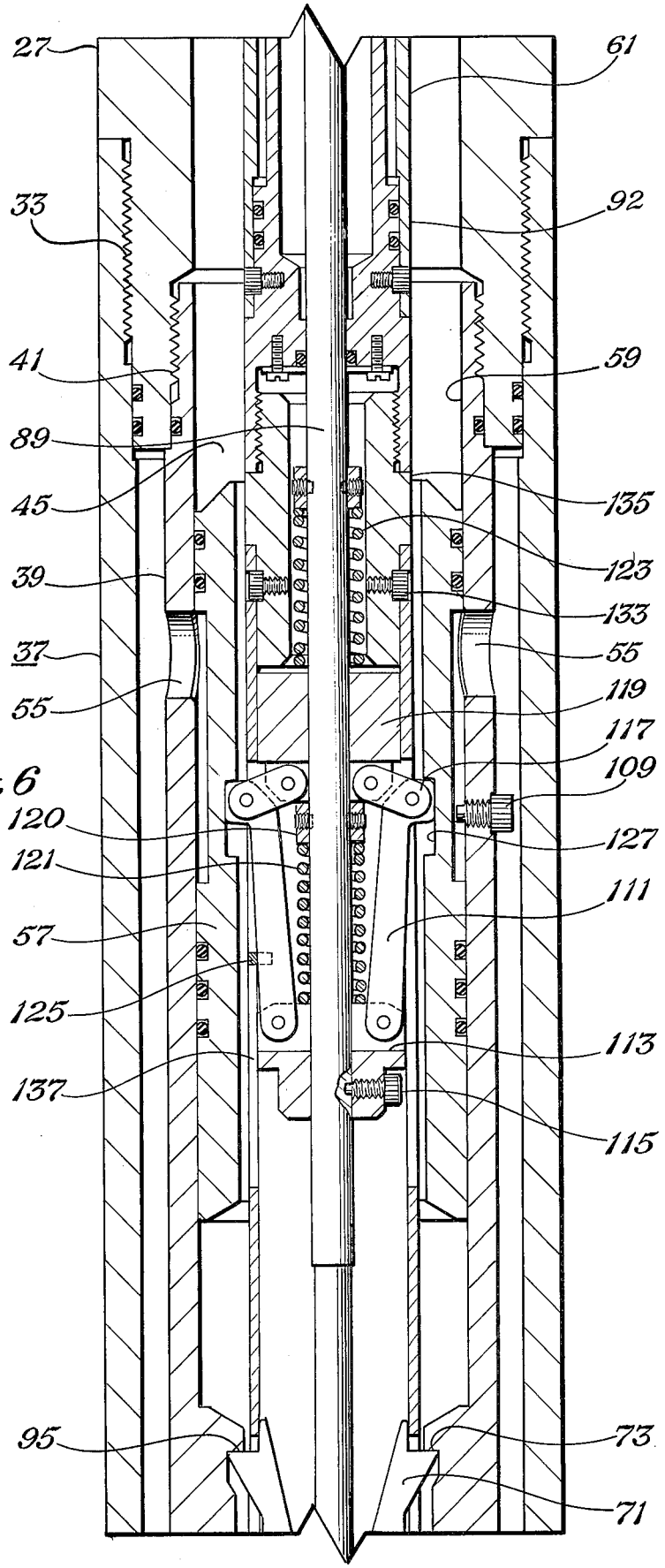
FIG. 6 is like the middle and upper portions of FIG. 3 except that it is somewhat enlarged and shows the apparatus in a third stage of operation.
Figure 7:
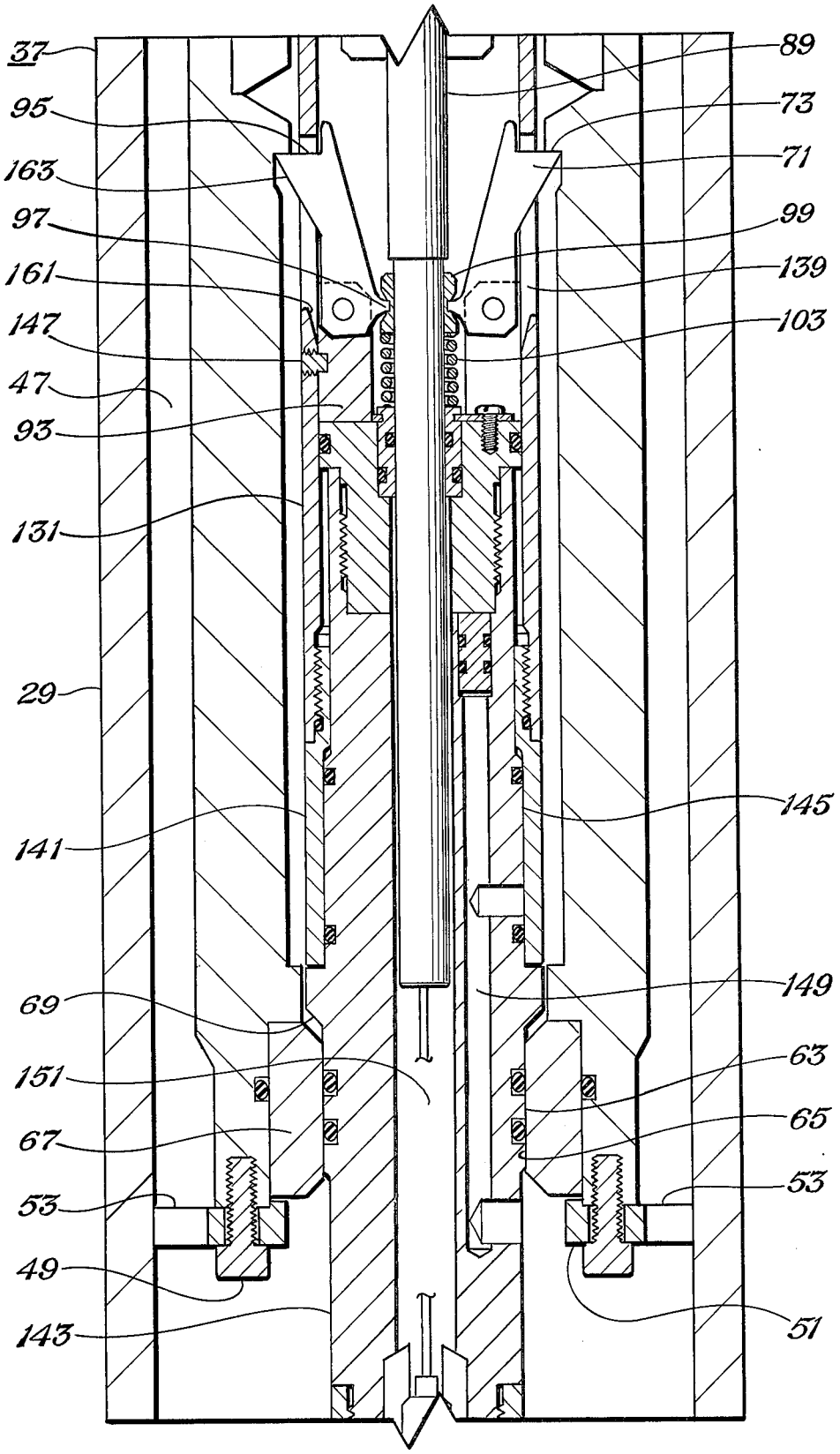
FIG. 7 is an enlarged view of the lower portion of FIG. 3, emphasizing portions of the apparatus that are involved in fail safe operation.

Next, the electric motor 79 is again energized to draw the drive sleeve 85 further upwardly, causing the drive shaft 89 to move further upwardly until it is stopped at its uppermost position by means of conventional limit switch means (not shown). As the drive shaft 89 moves further upwardly (toward its uppermost position) the upper latch arms 111 complete their extending (if they were not fully extended when the drive shaft 89 reached its intermediate position) and move upwardly within the annular recess 127 until they abut the shoulder formed by the upper extremity of the annular recess 127, after which time the sleeve valve 57 will begin to move upwardly. When the drive shaft 89 has reached its uppermost position, the sleeve valve 57 will have reached its closed position, as shown by FIG. 6.

When the sleeve valve 57 is closed, formation fluid is prevented from entering the bypass sub bore 43 above the sleeve valve 57 and consequently there will be a formation pressure buildup which can be sensed by pressure sensor means carried by the bottom section 77 of the wireline tool 61 and observed at the above ground equipment 25. When the formation pressure buildup has reached a steady state condition, the electric motor 79 may be energized in the direction to cause the drive shaft 89 to move downwardly to its intermediate position, at which time the electric motor 79 is stopped by conventional limit switch means (not shown). At this time, the sleeve valve 57 is again at its open position, permitting fluid from the formation and via the bypass sub portion 55 and the drill pipe 19 to the above ground equipment 25, so that appropriate flow tests can be made. It is apparent that the sleeve valve 57 can be actuated to its open or closed position, as necessary, to make the desired tests. It is also apparent that, since the activity of the pressure sensors carried by the wireline tool 61 can be observed at the above ground equipment 25, there is no guess work as to how long it takes for various phases of the formation pressure test procedure, and consequently, it is not necessary to waste valuable drilling rig time.

After all tests have been completed, and with the sleeve valve 57 in the open position, the electric motor 79 is again energized in the direction to move the drive shaft 89 to its lowermost position, causing both the upper latch arms 111 and the lower latch dogs 71 to move to their retracted position. The electric motor 79 is stopped at its lowermost position by conventional limit switch means (not shown). Next, the wireline tool 61 is withdrawn from the well 11, and then the circulation valve means is actuated in a conventional manner to shear pin 157 and move slidable sleeve 153 to open ports 159 to equlize pressures and permit circulation of the formation fluids out of the drill string above the bypass sub, after which the releasable packer 23 is released and the test string including the bypass sub 17 is withdrawn from the well 11.

A fourth important function of the wireline tool 61 is to provide for "fail safe" operation, in the event that, for any reason, the lower latch dogs 71 and/or the upper latch arms 111 cannot be retracted by normal operation of the electric motor 79 and the drive shaft 89.

Assume, for example, that the sleeve valve 57 is in its closed position, that the lower latch dogs 71 and the upper latch arms 111 are both in the extended position and that the electric motor 79 will not operate. The "fail safe" operation of the wireline tool 61 is then as follows. A first upward force is applied to the wireline 75 sufficient to cause shearing of the first shear pin 115. This force is transmitted from the wireline 75 to the wireline tool top section 92, and from there to the wall of the drive sleeve cylinder 87, from there to the housing of the electric motor 79, and from there via the drive tube 91 to the drive shaft 89. The shearing of the first shear pin 115 permits the first slidable collar 113 to move downwardly along the drive shaft 89 under the force of the second compression spring 121. This action causes the upper latch arms 111 to move to the retracted position. Additional upward force is then applied, sufficient to cause shearing of the second shear pin 147. This force is transmitted from the wireline 75 to the wireline tool top section 92, and from there via connector sub 135 to the wireline tool cylindrical body portion 131. The shearing of the second shear pin 147 permits the wireline tool cylindrical body portion 131 to move upwardly relative to the lower body portion 143, so that the "fail safe" seal cylinder 141 moves upwardly a sufficient distance to open the pressure equalizer passage 149 and thus allow fluid pressures above and below the wireline tool 61 to become equalized. Continued upward movement of the cylindrical body portion 131 causes cam surfaces 161 at the lower end portions of the slots 139 to engage corresponding follower surfaces 163 on the lower latch dogs 71 and force the lower latch dogs 71 to their retracted position, thus releasing the wireline tool 61 from the bypass sub 17. The wireline tool 61 may then be withdrawn from the well 11. If desired, the second shear pin 147 may be sheared first, and this may actually be preferable, although it is not essential that a particular shear pin be sheared first.

It is important to note that the "fail safe" arrangement above described allows for sufficient tension to be applied to the wireline 75, during the test operations and while the wireline tool 61 is seated and secured in the bypass sub 17, to prevent the kinking or snarling of the wireline 75 under abnormal pressure or flow conditions.

Figure 9:
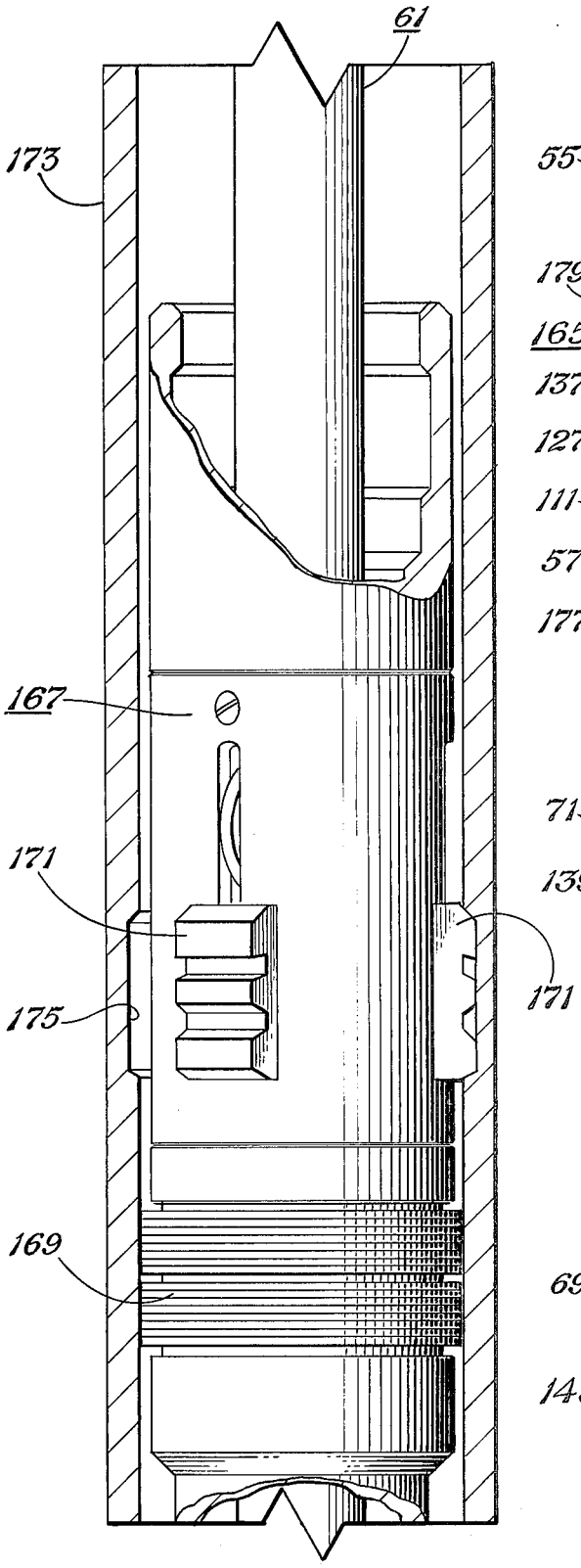
FIGS. 9 and 10 are schematic views, partially in section, showing (when placed end to end) apparatus of the invention in the form used for conducting tests in a production well.
Figure 10:
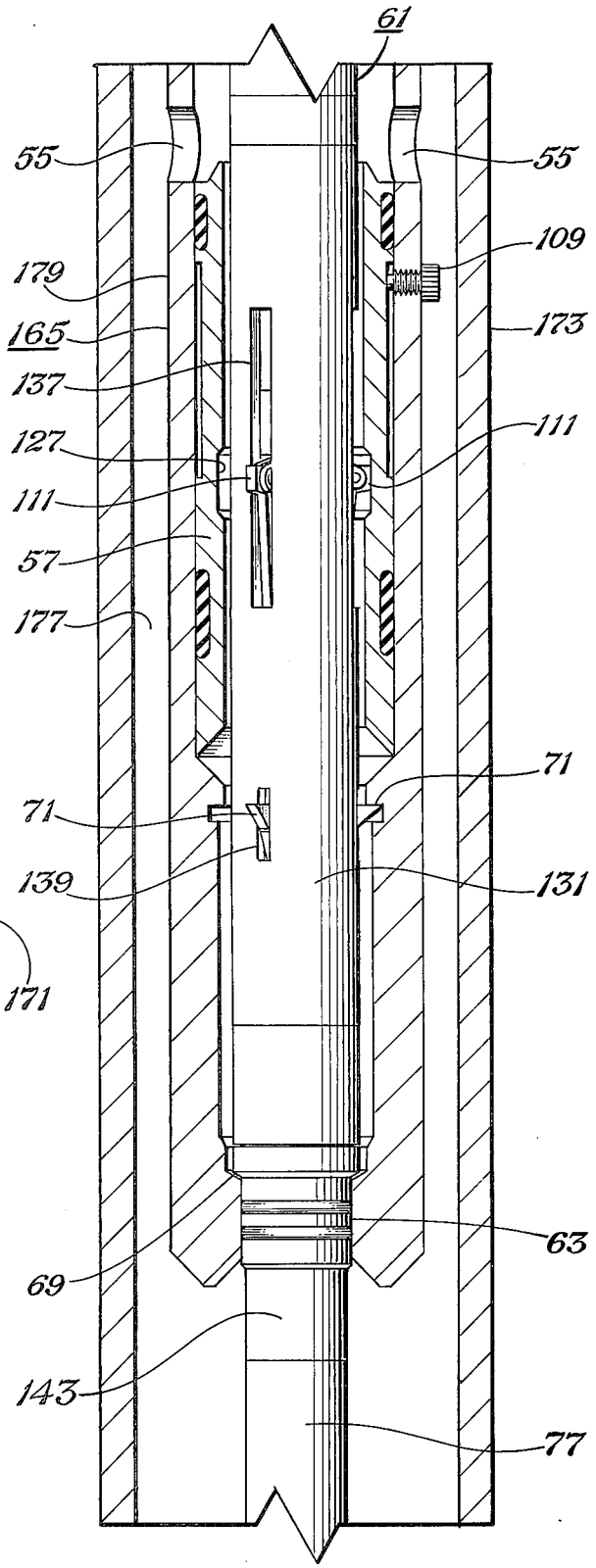

FIGS. 9 and 10 show an embodiment wherein the apparatus and methods of the embodiment of FIGS. 1–7 may be utilized in modified form to perform production testing operations. The reference numerals applied to FIGS. 9 and 10, when common to those used on FIGS. 1–7, refer to the same parts. The wireline tool 61 of FIGS. 9, 10 may be identical to that shown and described with reference to FIGS. 1–7, and, consequently, is not cut away or sectioned to show interior parts. The term "bypass sub" has been applied to the bypass sub 17 of FIGS. 1–7 as well as to the bypass sub 165 of FIGS. 9 and 10. These bypass subs 17, 165 have some structural differences, but have the same general function and purpose. In FIGS. 9, 10, the bypass sub 165 is shown attached at its upper end by conventional means such as threads (not shown) to the lower end of a locking seal assembly 167. The locking seal assembly 167 is of a conventional type carrying releasable packer means 169 and locking dogs 171. The bypass sub 165 and the locking seal assembly 167 are lowered by conventional means in production tubing 173 in the well to the testing location, where the locking dogs 171 are actuated to lock on a landing nipple 175 in the production tubing 173. The releasable packer means 169 is then set so that when the sleeve valve 57 is in the closed position, the fluid in the production tubing 173 above the releasable packer means 169 is isolated from that below the releasable packer means. The sleeve valve 57 is in the open position when the bypass sub 165 is lowered in the production tubing. After the locking seal assembly 167 is locked into the landing nipple 175 and the releasable packer means 169 is set, the wireline tool 61 is run into the production tubing 173 and is seated and secured in the bypass sub 165 in the same manner as that described herein with reference to the embodiment of FIGS. 1–7. The operation of the lower latch dogs 71 and the upper latch arms 111 and the sleeve valve 57; as well as the "fail safe" operation, is the same as that described herein with reference to the embodiment of FIGS. 1–7.

The structural differences between the bypass sub 17 and the bypass sub 165 will now be described. The bypass sub 17 was made up of top, intermediate and bottom outer housing portions 27, 29, 31 and an inner housing 39, with a bypass passage means or annulus 47 being formed by the intermediate housing portion 29 and the inner housing 39. However, in the case of bypass sub 165, the bypass passage means or annulus 177 is formed by the exterior of the housing 179 of bypass sub 165 and the interior of the production tubing 173. Consequently, the housing 179 of the bypass sub 165 can consist of a single tubular section the general structure of which can be the same as that of the inner housing 39 of the bypass sub 17. Also, in the case of bypass sub 165, there is no need for a circulation valve means.

The steps in carrying out the method of the invention for providing concurrent surface indication of an earth formation characteristic during a drill stem testing operation may be stated as follows:

a. run in on drill sting a bypass sub with bypass passages open and releasable packer means to a location above and near the formation to be tested; the bypass sub having a bore extending throughout its length, with said bore having a bypass portion adapted for removeably receiving a wireline tool in sealing engagement with said bore, bypass passage means communicating with said bore via upper port means disposed above the region of said sealing engagement and lower port means disposed below the region of said sealing engagement; said bypass sub further including closure means for selectively opening and closing one of said port means; and the releasable packer means, when set, permitting fluid flow from the formation to be tested to said bypass sub but otherwise isolating formation fluid below said packer means from well bore fluids above said packer means;
b. run in and seat in bypass sub wireline tool including an earth formation characteristic sensor device:
c. set releasable packer means;
d. actuate said closure means to close said bypass passage means and observe above ground the formation pressure buildup;
e. when formation pressure reaches a steady state condition, actuate said closure means to open said bypass passage means and make flow tests and then actuate said closure means to close said bypass passage means and again observe formation pressure buildup until the steady state condition is reached and then actuate said closure means to open said bypass passage means;
f. remove wireline tool from well bore;
g. establish reverse circulation to remove formation fluids from drill string;
h. release said releasable packer means;
i. pull out bypass sub and releasable packer means.

The steps in carrying out the method of the invention for providing concurrent surface indication of an earth formation characteristic during a production testing operation may be stated as follows:

a. run into production tubing a bypass sub fixed to the lower end of a locking seal assembly including a releasable packer means and dispose and lock said assembly at a location above and near the formation to be tested; the bypass sub having a bore extending throughout its length, with said bore adapted for removeably receiving a wireline tool in sealing engagement therewith, port means disposed above the region of said sealing engagement and communicating said bore with said bypass sub exterior and consequently said formation fluids; said bypass sub further including closure means for selectively opening and closing said port means; and the releasable packer means, when set, permitting fluid flow from the formation to be tested via said bypass sub and said conduit means to aboveground equipment but otherwise isolating formation fluid below said packer means;
b. run in and seat in bypass sub wireline tool including an earth formation characteristic sensor device;
c. set releasable packer means;
d. actuate said closure means to close said port means and observe above ground the formation pressure buildup;
e. when formation pressure reaches a steady state condition, actuate said closure means to open said port means and make flow tests and then actuate said closure means to close said port means and again observe formation pressure buildup until the steady state condition is reached and then actuate said closure means to open said port means;
f. remove wireline tool from well bore;
g. release said releasable packer means;
h. pull out bypass sub and releasable packer means.

In the embodiments shown and described herein, means for selectively actuating the bypass closure means (sleeve valve 57) is the motorized sleeve shifter means provided by the wireline tool 61. It should be understood that, in accordance with the broader aspects of the invention, other actuating means could be utilized, as for example, gas powered means incorporated in the bypass sub itself.

Conventional sealing means, such as the O-rings shown in the drawings, are, of course, utilized where needed, and these have not been specifically designated or described.

The use of electric motors incorporated in wireline tools to perform various downhole functions is well known and, consequently, details concerning same such as wiring, control, type and the like, have not been included herein. Details concerning the wiring and control of the sensor devices contained in the wireline tool bottom section have been omitted for the same reason. Likewise, details concerning the releasable packer means and the manner of setting and releasing same have been omitted. It should be understood that the arrangement for lowering, suspending and securing the bypass sub in the production testing embodiment could take various forms other than that shown and described, such lowering, suspending and securing means are well known and could readily be adapted for use with a bypass sub such as that shown and described herein.

The foregoing disclosure and the showings made in the drawings are merely illustrative of the principles of this invention and are not to be interpreted in a limiting sense.

What is claimed is:

1. Apparatus for concurrent surface indication of an earth formation characteristic during a drill stem testing operation, comprising:

a. a bypass sub to be disposed in a wellbore above the formation to be tested and to be connected to conduit means for communicating fluids via said bypass sub from said formation to aboveground equipment; said bypass sub having a bore extending throughout its length, with said bore having a bypass portion adapted for removably receiving a wireline tool in sealing engagement with said bore, bypass passage means communicating with said bore via upper port means disposed above the region of said sealing engagement and lower port means disposed below the region of said sealing engagement; said bypass sub further including closure means for selectively opening and closing one of said port means;

b. releasable packer means for permitting fluid flow from the formation to be tested to said bypass sub but otherwise isolating formation fluid below said packer means from wellbore fluids above said packer means;

c. a wireline tool to be removably received by said bore bypass portion and including an earth formation characteristic sensor device; and d. means for selectively actuating said closure means while said wireline tool is in place in said bypass sub.

2. The apparatus of claim 1 wherein said earth formation characteristic sensor device includes one or more fluid pressure sensor devices.

3. The apparatus of claim 2 wherein said port closure means is a sleeve valve associated with said upper port means.

4. The apparatus of claim 2 wherein there is further provided circulation valve means disposed at the upper end region of said bypass sub and comprising circulation port means communicating between said bore and the outside of said bypass sub and normally closed by a slidable sleeve.

5. The apparatus of claim 2 wherein said releasable packer means is incorporated in a drill stem tester assembly connected to and below said bypass sub.

6. The apparatus of claim 2 wherein said bypass portion of said bore comprises an inner housing, and said bypass passage means comprises an annulus between said inner housing exterior and the outer wall of said bypass sub, and said upper port means is disposed at the upper region of said inner housing and said lower port means is disposed at the lower region of said bypass portion.

7. Method for providing concurrent surface indication of an earth formation characteristic during a drill stem testing operation, comprising the steps of:

a. run in on drill string a bypass sub with bypass passages open and releasable packer means to a location above and near the formation to be tested; the bypass sub having a bore extending throughout its length, with said bore having a bypass portion adapted for removeably receiving a wireline tool in sealing engagement with said bore, bypass passage means communicating with said bore via upper port means disposed above the region of said sealing engagement and lower port means disposed below the region of said sealing engagement; said bypass sub further including closure means for selectively opening and closing one of said port means; and the releasable packer means, when set, permitting fluid flow from the formation to be tested to said bypass sub but otherwise isolating formation fluid below said packer means from well bore fluids above said packer means;

b. run in and seat in bypass sub wireline tool including an earth formation characteristic sensor device;

c. set releasable packer means;

d. actuate said closure means to close said bypass passage means and observe above ground the formation pressure buildup;

e. when formation pressure reaches a steady state condition, actuate said closure means to open said bypass passage means and make flow tests and then actuate said closure means to close said bypass passage means and again observe formation pressure buildup until the steady state condition is reached and then actuate said closure means to open said bypass passage means;

f. remove wireline tool from well bore;

g. establish reverse circulation to remove formation fluids from drill string;

h. release said releasable packer means;

i. pull out bypass sub and releasable packer means.

8. The method of claim 7 wherein said earth formation characteristic sensor device includes one or more fluid pressure sensor devices.

9. Apparatus for concurrent surface indication of an earth formation characteristic during a production testing operation, comprising:

a. a bypass sub to be disposed in a wellbore above the formation to be tested and to be connected to conduit means for communicating fluids via said bypass sub from said formation to above-ground equipment; said bypass sub having a bore extending throughout its length; with said bore adapted for removably receiving a wireline tool in sealing engagement therewith, port means disposed above the region of said sealing engagement and communicating said bore with said bypass sub exterior and consequently said formation fluids said bypass sub further including closure means for selectively opening and closing said port means;

b. releasable packer means for permitting fluid flow from the formation to be tested via said bypass sub and said conduit means to aboveground equipment but otherwise isolating formation fluid below said packer means;

c. a wireline tool to be removably received by said bore and including an earth formation characteristic sensor device; and d. means for selectively actuating said closure means while said wireline tool is in place in said bypass sub.

10. The apparatus of claim 9 wherein said earth formation characteristics sensor device includes one or more fluid pressure sensor devices.

11. The apparatus of claim 10 wherein said port closure means is a sleeve valve.

12. Method for providing concurrent surface indication of an earth formation characteristic during a production testing operation, comprising the steps of:

a. run into production tubing a bypass sub fixed to the lower end of a locking seal assembly including a releasable packer means and dispose and lock said assembly at a location above and near the formation to be tested; the bypass sub having a bore extending throughout its length, with said bore adapted for removeably receiving a wireline tool in sealing engagement therewith, port means disposed above the region of said sealing engagement and communicating said bore with said bypass sub exterior and consequently said formation fluids; said bypass sub further including closure means for selectively opening and closing said port means; and the releasable packer means, when set, permitting fluid flow from the formation to be tested via said bypass sub and said conduit means to aboveground equipment but otherwise isolating formation fluid below said packer means;

b. run in and seat in bypass sub wireline tool including an earth formation characteristic sensor device;

c. set releasable packer means;

d. actuate said closure means to close said port means and observe above ground the formation pressure buildup;

e. when formation pressure reaches a steady state condition, actuate said closure means to open said port means and make flow tests and then actuate said closure means to close said port means and again observe formation pressure buildup until the steady state condition is reached and then actuate said closure means to open said port means;

f. remove wireline tool from well bore;

g. release said releasable packer means;

h. pull out bypass sub and releasable packer means.

13. The method of claim 12 wherein said earth formation characteristic sensor device includes one or more fluid pressure sensor devices.

* * * * *